United States Patent [19]

Berger

[11] Patent Number: 4,693,640

[45] Date of Patent: Sep. 15, 1987

[54] METHOD OF CONTROLLING HYDRAULICALLY ACTUATABLE ARRANGEMENT IN UNDERGROUND MINING

[75] Inventor: Karl-Heinz Berger, Gelsenkirchen-Resse, Fed. Rep. of Germany

[73] Assignee: Bochumer Eisenhütte Heintzmann GmbH & Co KG, Bochum, Fed. Rep. of Germany

[21] Appl. No.: 893,568

[22] Filed: Aug. 5, 1986

[30] Foreign Application Priority Data

Oct. 28, 1986 [DE] Fed. Rep. of Germany ..... 3538251

[51] Int. Cl.[4] ..... E21D 23/12

[52] U.S. Cl. ..... 405/294; 405/302

[58] Field of Search ..... 405/291, 293, 294, 299, 405/302; 91/170 MP; 299/1, 33

[56] References Cited

U.S. PATENT DOCUMENTS 3,664,138 5/1972 Cooper ..... 405/302

4,398,851 8/1983 Geuns et al. ..... 405/302

4,451,181 5/1984 Trumper et al. ..... 405/302

4,518,285 5/1985 Weber et al. ..... 405/302

*Primary Examiner*—David H. Corbin

*Attorney, Agent, or Firm*—Michael J. Striker

[57] ABSTRACT

A method of controlling a plurality of hydraulically-actuated arrangements in underground excavations, comprises the steps of providing an electrical power supply, connecting a plurality of control devices with said power supply and interconnecting the control devices with one another, arranging a plurality of current-suppliable consumers to be connected with the control devices, comparing in each of the control devices a coded information about a number of consumers which have been current supplied from the power supply with a maximum possible number of consumers which can be supplied from the power supply, determining from the comparison the number of the consumers which still can be current-supplied and obtaining by the control device a release for current supplying such consumers, adding consumers which are released by the control device and current supplied with the consumers which have been indicated in the control device as current-supplied, and further transferring the result of the addition in coded form to a next control device.

5 Claims, 2 Drawing Figures

METHOD OF CONTROLLING HYDRAULICALLY ACTUATABLE ARRANGEMENT IN UNDERGROUND MINING

BACKGROUND OF THE INVENTION

The present invention relates to a method of controlling a plurality of arrangements which are actuatable with a hydraulic working medium substantially one after the other, in underground mining works.

The arrangements which are to be controlled are, for example, return cylinder-piston units and cylinder-piston units of underground supports connected with return cylinders during movement process. Particularly, the supports in this case are mine roof supports. Moreover, these arrangements can be formed by respective hydraulically actuatable cylinder-piston units which are used in supporting process for level control of an excavation machine.

The specific features of such hydraulically actuatable arrangements is that mainly they are not actuated simultaneously and electrically controlled for this purpose, but instead they are supplied with hydraulic working medium substantially one after the other at certain time points.

Consumers of electric energy are associated with these cylinder-piston units, for example in form of electromagnetic valves, which together with respective control devices are connected with an electric power supply in intrinsically safe designs. The control devices with integrated input and output blocks as well as computer units perform, for example, exact subsequent movement of the cylinder-piston units of the displaceable cap elements in dependence upon the positions of the return cylinder-piston units or the level control of an excavation device in accordance with the respective local conditions.

Electrical intrinsically safe power supplies have, however, only a limited electrical power. Therefore, only so many control devices and current-supplying consumers are associated with one power supply, which can be supplied with power in current-supplying condition from the respective power supply. This approach however possesses the disadvantage that a greater number of electro-hydraulic control circuits is necessary, with the respective required electrical and mechanical expenditures. This is especially disadvantageous in conditions of underground mining works.

SUMMARY OF THE INVENTION

Accordingly, it is an object of the present invention to provide a method of controlling a plurality of arrangements actuatable with a hydraulic working medium one after the other, which avoids the disadvantages of the prior art.

More particularly, it is an object of the present invention to provide a method of controlling a plurality of arrangements hydraulically actuatable one after the other in underground mining, which is performed so that the number of electro-hydraulic control circuits and thereby the electric and hydraulic expenditures can be considerably reduced.

In keeping with these objects and with others which will become apparent hereinafter, one feature of the present invention resides, briefly stated, in that in a first control device first the coded informations from a neighboring control device about the number of consumers supplied with current from a power supply is compared with the maximum possible number of the consumers which can be supplied from the power supply, and after determination of consumers which still are to be supplied with current, by the control device a release for current supply of these consumers is obtained. Then the addition is performed of the consumers released and current supplied from the control device,- with the current supplied consumers signalled in the control device, and the result is transferred in coded form to a next control device.

When the method is performed in accordance with the present invention, from consumers which are connected to a power supply in predominant number of cases of all operational situations, not all consumers, but always only a fraction is supplied with current. Care should be taken that, with the aid of the computer units in the control devices connected to a power supply, it is permanently determined how many current-suppliable consumers with the consideration of the basic load are supplied with current by the control devices, so that then by the control devices those consumers can be released for current supply which are given from the difference between the maximum number of consumers suppliable from the power supply and the actual current-supplied consumers.

The advantage of this method is that a considerably greater number of control devices and current-suppliable consumers can be connected with one power supply than the number which can normally be supplied from the power supply with its power. Since the regulating electronic system of the control devices continuously determines how many consumers from the maximum current-suppliable consumers are actually supplied with current, and in dependence on this testing releases then the current-suppliable consumers for current supply, an overloading of the power supply can be avoided with safety and considerably higher number of consumers can be connected to the power supply, than that which can be powered in current-supplied conditions. The economy effect both in the electrical and mechanical parts of such control, amounts to 50% relative to the conventional methods. This means that, for example, in a mine roof support control, only half of conventionally required power supplies is now needed for guaranteeing that over the entire length of the gallery the correct following of the displaceable caps to the positions of the associated return cylinder-piston units is achieved in dependence upon the excavation progress by an excavating machine (planing machine or cutting machine).

The inventive features can be used not only in the above described displaceable cap control, but also can be used with the same advantages for a plurality of electriclly actuated consumers which must not be simultaneously provided with current from a power supply.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF A PREFERRED EMBODIMENT

Figure 1:
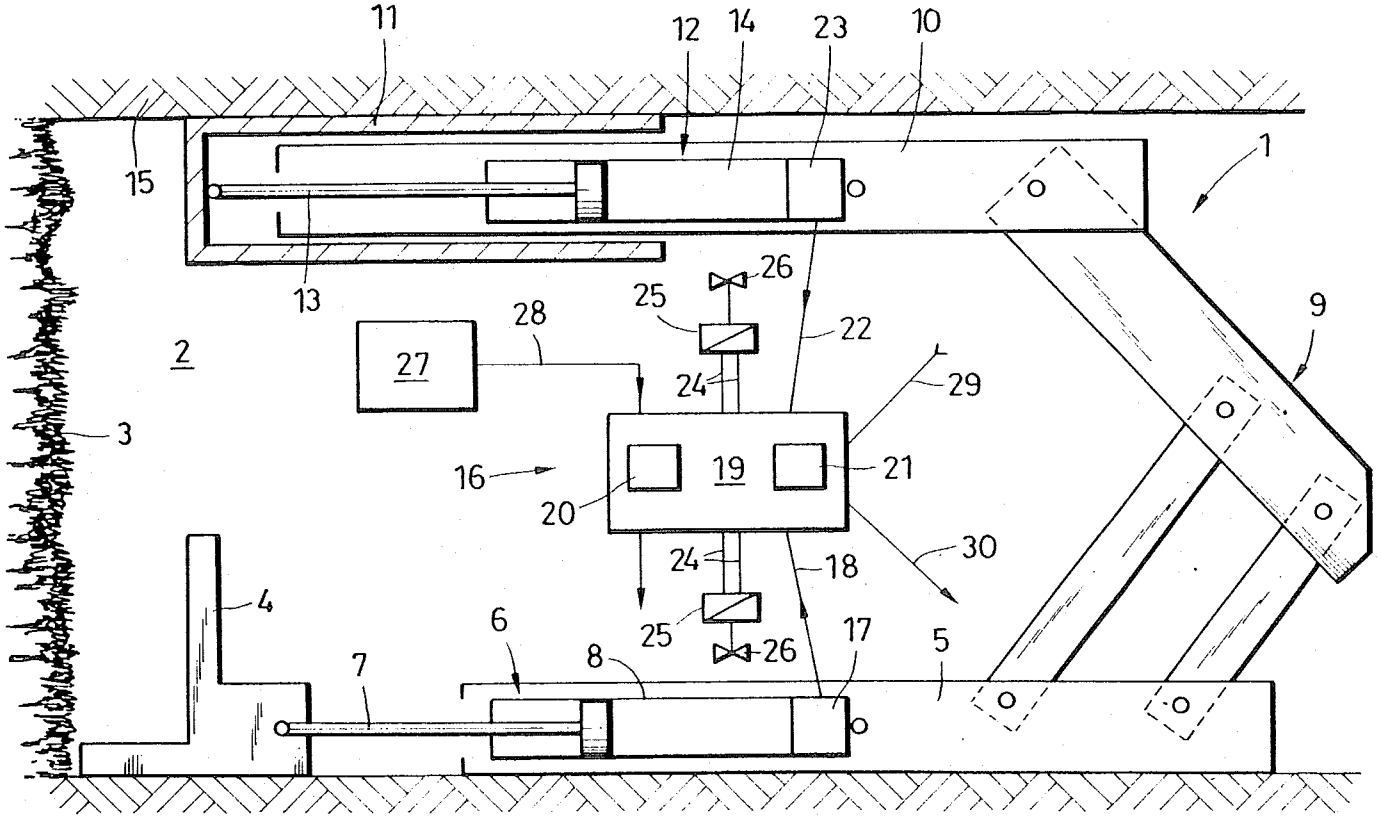
FIG. 1 is a view schematically showing an electro-hydraulic displaceable cap control in a mine roof support in accordance with the present invention.

A mine roof support is identified with reference numeral 1 in FIG. 1. This mine roof support together with other mine roof supports which are arranged directly one after the other in a longitudinal direction of a gallery, provides for the safety of a gallery space against breaking-in of rock and mineral.

An abutment 4 extends forwardly of the mine roof support 1 along a face of a working 3. A not shown excavating device can be positively displaced on the abutment 4 for excavating the minerals contained in the working face 3. The abutment 4 can be formed, for example, as a scraper chain conveyor. It is connected with floor beams 5 of the mine roof support 1 via a hydraulically actuatable return cylinder-piston unit 6. Piston rods 7 of the cylinder-piston unit 6 are connected with the abutment 4, while housings 8 of the cylinder-piston unit are articulately connected with floor beams 5.

The floor beams 5 are connected with caps 10 of the mine roof supports 1 via lemniscate linkages 9. The caps 10 are provided with displaceable cap elements 11 which are displaceable relative to the caps 10 by means of hydraulically actuatable cylinder-piston units 12. The cylinder-piston units 12 have piston rods 13 which are connected with displaceable cap elements 11, and housings 14 which are articulately connected with main caps 10.

In order to support a freely lying roof 15 as close as possible to the working face 3, an electro-hydraulic control 16 is provided. In the course of displacement of the abutment 4 during progressing of the excavation works, the electro-hydraulic control 16 automatically displaces also the displaceable cap elements 14 by a respective distance. When the abutment 4 is displaced by the return cylinder-piston unit 6, the covered path is transmitted to a sensor 17 which is formed, for example, as a potentiometer. The sensor 17 transmits an electrical signal digitally or analogously via a data conduit 18 to a control device 19. Input and output blocks 20 and a computer unit 21 is integrated in the control device 19. On the other hand, the control device 19 is connected via a data conduit 22 with a sensor 23 which is associated with the cylinder-piston unit 12 of the displaceable cap elements.

The control device 19 permanently compares the actual position of the cylinder-piston unit 12 of the displaceable cap elements with the actual position of the return cylinder-piston unit 6 and determines, with the aid of the computer unit 21, the nominal position of the cylinder-piston unit 12 of the displaceable cap elements associated with the return cylinder 6. Subsequently, the control device 19 serves for respectively hydraulically actuating the cylinder-piston unit 12 of the displaceable cap elements, so that the nominal position of the cylinder-piston unit 12 coincides with the actual position of the return cylinder 6. For this purpose the control device 12 is connected via control conduits 24 with electrically powered consumers 25 with associated control valves 26 on the cylinder-piston units 6 and 12.

The electric supply of the control device 19 as well as the consumers 25 is performed from a power supply 27 in intrinsically safe arrangement, via a supply conduit 28.

As can be recognized from FIG. 1, the power supply 27 is connected via the supply conduit 28 with further control devices 19, and the control device 19 is connected via data conduits 29, 30 with further control devices 19*a*, 19*b*, etc. of the neighboring mine roof supports 1.

Figure 2:
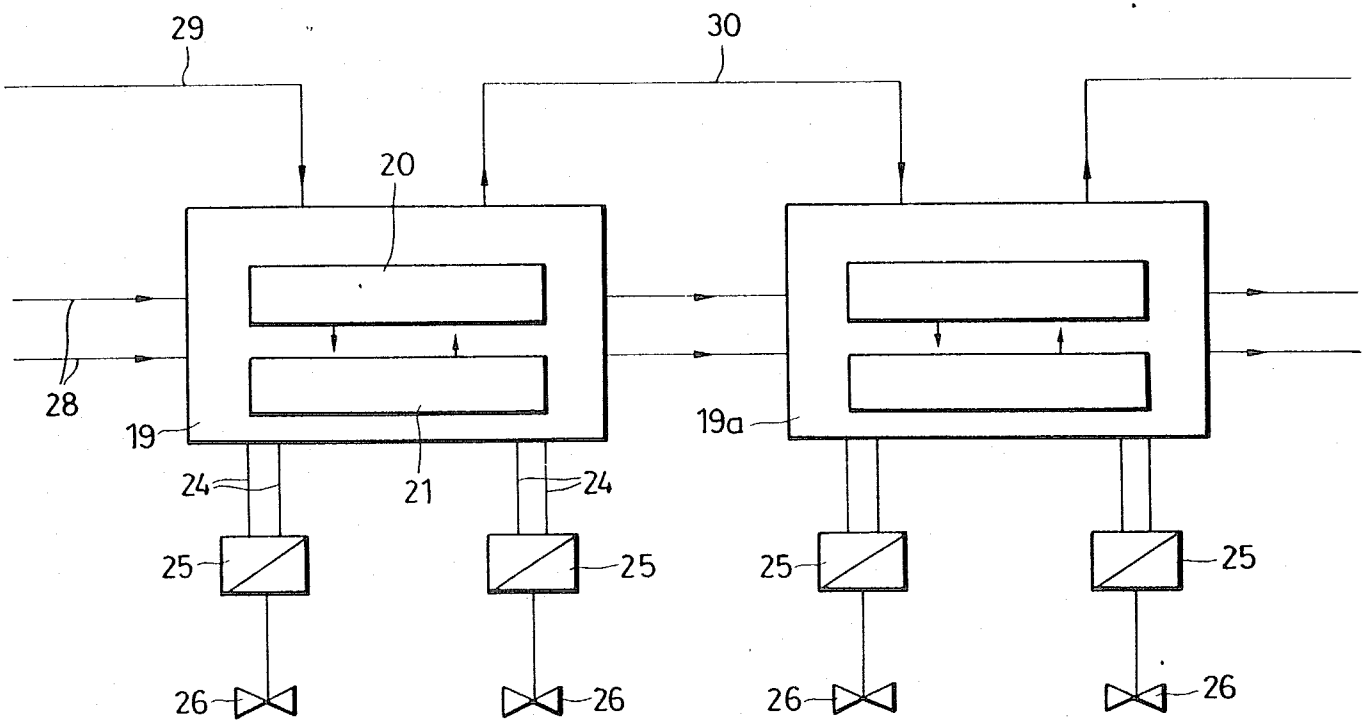
FIG. 2 is a view showing a part of a wiring diagram for an electrical circuit of this control.

FIG. 2 shows the coupling of the control devices 19, 19*a*, of two neighboring mine roof supports 1 for controlling the displaceable cap elements.

It can be seen that the control devices 19, 19*a*, etc. are permanently connected with the supply conduits 28 with the not shown power supply 27. The number of consumers 25 which are supplied with current from the associated power supply 27 at the time moment is transmitted to the control device 19 via the data conduit 29 from the control device 19 of the preceding mine roof support 1 in a coded form. The computer unit 21 in the control device 19 compares the number of the consumers 25 which are under current, with a maximum number of current-powerable consumers 25 provided by the power of the power supply 27. If during this comparison it is determined that another consumer can be supplied with current from the current supply 27, the control device 19 obtains a release on the respective consumer 25. When required, this consumer 25 can now also be supplied with current.

When a current supply takes place, the consumers 25 supplied with current via the data conduit 29 are added with the consumers 25 which are additionally supplied with current after release through the control device 19. This result is transmitted via the data conduit 30 to a control device 19*a* of the neighboring mine roof support 1, in which the same comparison process takes place.

It will be understood that each of the elements described above, or two or more together, may also find a useful application in other types of constructions differing from the types described above.

While the invention has been illustrated and described as embodied in a method of controlling hydraulically actuatable arrangements in underground mining, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A method of controlling a plurality of hydraulically-actuated arrangements in underground excavations, comprising the steps of providing an electrical power supply; connecting a plurality of control devices with said power supply and interconnecting the control devices with one another; arranging a plurality of current-suppliable consumers to be connected with the control devices; comparing in each of the control devices a coded information about a number of consumers which have been current supplied from the power supply with a maximum possible number of consumers which can be supplied from the power supply; determining from the comparison the number of the consumers which still can be current-supplied and obtaining by the control device a release for current supplying such consumers;

adding consumers which are released by the control device and current supplied with the consumers which have been indicated in the control device as current-supplied; and further transferring the result of the addition in coded form to a next control device.

2. A method as defined in claim 1, wherein said providing step includes providing the electrical power supply with intrinsically safe arrangement.

3. A method as defined in claim 1, wherein said step of interconnecting the control devices with one another includes interconnecting the control devices by at least one data conduit.

4. A method as defined in claim 1, wherein said connecting step includes connecting the control devices having input and output blocks and computing units.

5. A method as defined in claim 1, wherein said connecting step includes connecting the control devices with displaceable caps and return cylinders of a mine roof support for displacing the displaceable caps in dependence on positions of the return cylinders.

* * * * *